US007029319B2

(12) United States Patent
Kunishi

(10) Patent No.: US 7,029,319 B2
(45) Date of Patent: Apr. 18, 2006

(54) FLAT CIRCUIT CONNECTOR

(75) Inventor: Shinsuke Kunishi, Hadano (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/972,526

(22) Filed: Oct. 25, 2004

(65) Prior Publication Data

US 2005/0118860 A1 Jun. 2, 2005

(30) Foreign Application Priority Data

Oct. 28, 2003 (JP) ..... 2003-367039

(51) Int. Cl.
*H01R 12/24* (2006.01)

(52) U.S. Cl. ..... 439/492; 439/260; 439/329

(58) Field of Classification Search ..... 439/260, 439/329, 492
See application file for complete search history.

(56) References Cited

U.S. PATENT DOCUMENTS 5,074,797 A * 12/1991 Yamada ..... 439/62
6,247,951 B1 * 6/2001 Di Liello et al. ..... 439/329
6,352,442 B1 * 3/2002 Kudo ..... 439/260
6,767,233 B1 * 7/2004 Tsunematsu ..... 439/260
6,773,287 B1 * 8/2004 Takashita ..... 439/260
6,821,158 B1 * 11/2004 Iida et al. ..... 439/660
6,884,108 B1 * 4/2005 Saito et al. ..... 439/495

FOREIGN PATENT DOCUMENTS

| | | |
|---|---|---|
| JP | 9-35828 | 2/1997 |
| JP | 10/189174 | 7/1998 |
| JP | 2001-196130 | 7/2001 |
| JP | 2002-134195 | 5/2002 |
| JP | 2003-45527 | 2/2003 |
| JP | 2003-208946 | 7/2003 |

* cited by examiner

*Primary Examiner*—Truc Nguyen
(74) *Attorney, Agent, or Firm*—Stephen Z. Weiss

(57) ABSTRACT

An electrical connector is provided for terminating a flat electrical circuit which has a given width and an insertion end narrower than the given width to define at least one shoulder section at a side of the circuit. The connector includes a dielectric housing having opening for receiving the insertion end of the flat circuit in an insertion direction. A plurality of terminals are mounted on the housing at the opening. An actuator is movably mounted on the housing for movement between an open position allowing the insertion end of the flat circuit to be inserted into the opening, and a closed position to relatively bias the flat circuit against the terminals. A circuit-suppressing member projects outwardly of the housing opposite the insertion direction for engaging the shoulder section of the flat circuit to prevent the flat circuit from being bent upwardly against the actuator.

5 Claims, 4 Drawing Sheets

FLAT CIRCUIT CONNECTOR

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals.

In a widely used type of flat circuit connector, the flat circuit is insertable into a slot at the front of the connector housing, and the actuator is pivotally mounted on the housing generally at the top, front thereof overlying the slot in a closed position of the actuator. Problems are encountered with these types of flat circuit connectors if an operator pulls outwardly on a terminated flat circuit, especially if the pulling forces are inclined upwardly. The flat circuit has a tendency to pivot the actuator upwardly away from its closed position. This loosens the connections between the contact pads on the flat circuit and the contact portions of the terminals on the connector housing and, thereby, adversely affects or destroys the electrical connections therebetween.

In order to solve these problems, attempts have been made to provide anti-pulling means on the connector as shown in Japan Patent No. 3029985; Japan Patent Laid-Open No. 2003-45527; and Japan Patent Laid-Open No. 10-189174. The anti-pulling means is provided by anti-pulling projections which prevent displacement of the flat circuit under the actuator when the flat circuit is pulled outwardly and upwardly. The anti-pulling projections extend horizontally inwardly, generally toward each other, from opposite sides of the opening or slot in the housing which receives the end of the flat circuit. These anti-pulling projections cause further problems in that they interfere with the insertion of the flat circuit into the opening or slot. Since many flat circuit connectors are mounted on printed circuit boards, the flat circuit must be inserted into the connector very close to and parallel to the circuit board and the bottom of the connector housing in order to get under the projections, which is quite difficult with miniaturized connectors. The present invention is directed to solving these problems.

SUMMARY OF THE INVENTION

An object, therefore, of the invention is to provide a new and improved flat circuit connector of the character described.

In the exemplary embodiment of the invention, a flat circuit connector is provided for terminating a flat electrical circuit which has a given width and an insertion end narrower than the given width to define at least one shoulder section at a side of the circuit. The connector includes a dielectric housing having opening for receiving the insertion end of the flat circuit in an insertion direction. A plurality of terminals are mounted on the housing at the opening. An actuator is movably mounted on the housing for movement between an open position allowing the insertion end of the flat circuit to be inserted into the opening, and a closed position to relatively bias the flat circuit against the terminals. A circuit-suppressing member projects outwardly of the housing opposite the insertion direction for engaging the shoulder section of the flat circuit to prevent the flat circuit from being bent upwardly against the actuator.

According to one aspect of the invention, the circuit-suppressing member is located outside the opening for engaging the shoulder section of the flat circuit. The circuit-suppressing member projects outwardly from a front face of the housing in a direction generally parallel to and opposite the insertion direction.

According to another aspect of the invention, the circuit-suppressing member is separate from the housing and is mounted in a slot in the housing. The circuit-suppressing member includes a mounting portion inserted into the slot and a head portion projecting from the housing for engaging the shoulder section of the flat circuit. In the preferred embodiment, the circuit-suppressing member is stamped of metal material.

As disclosed herein, the flat electrical circuit includes a pair of the shoulder sections at opposite sides thereof. The connector includes a pair of the circuit-suppressing members projecting outwardly of the housing outside opposite ends of the opening for engaging the pair of shoulders.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
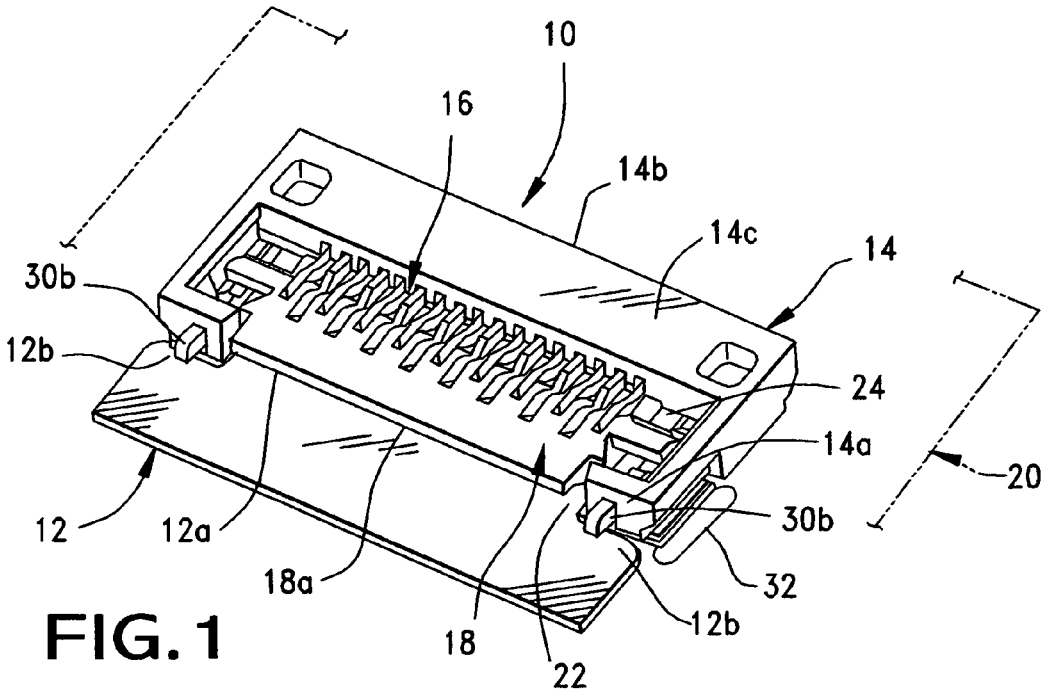
FIG. 1 is a top perspective view of a flat circuit connector according to the invention, receiving a flat circuit and with the actuator in its closed position.
Figure 2:
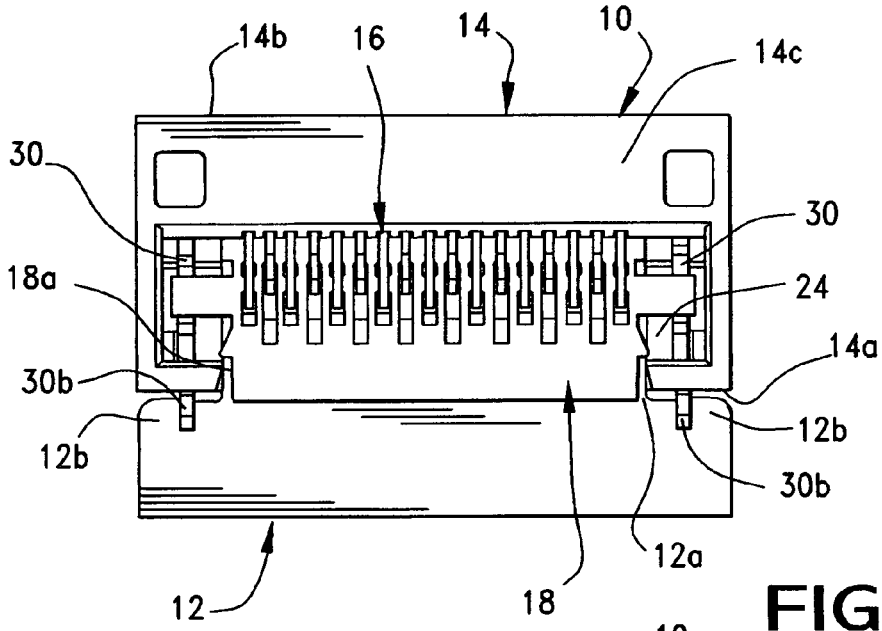
FIG. 2 is a top plan view of the connector as shown in FIG. 1.
Figure 3:
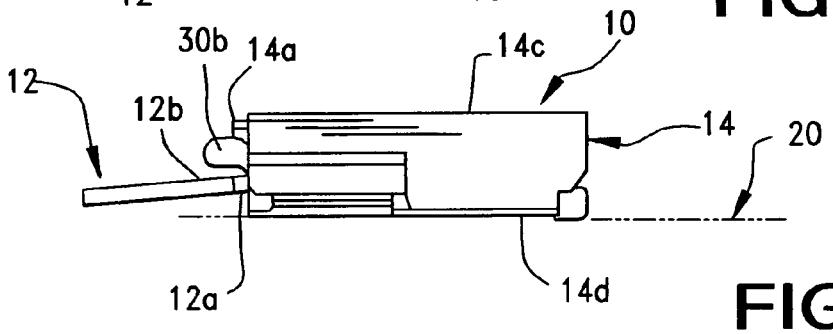
FIG. 3 is a side elevational view of the connector, looking at the right-hand side of FIG. 2.
Figure 4:
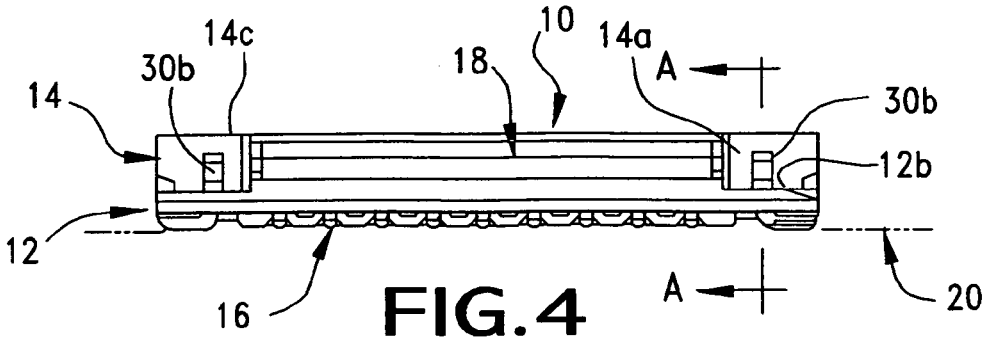
FIG. 4 is a front elevational view of the connector.
Figure 5:
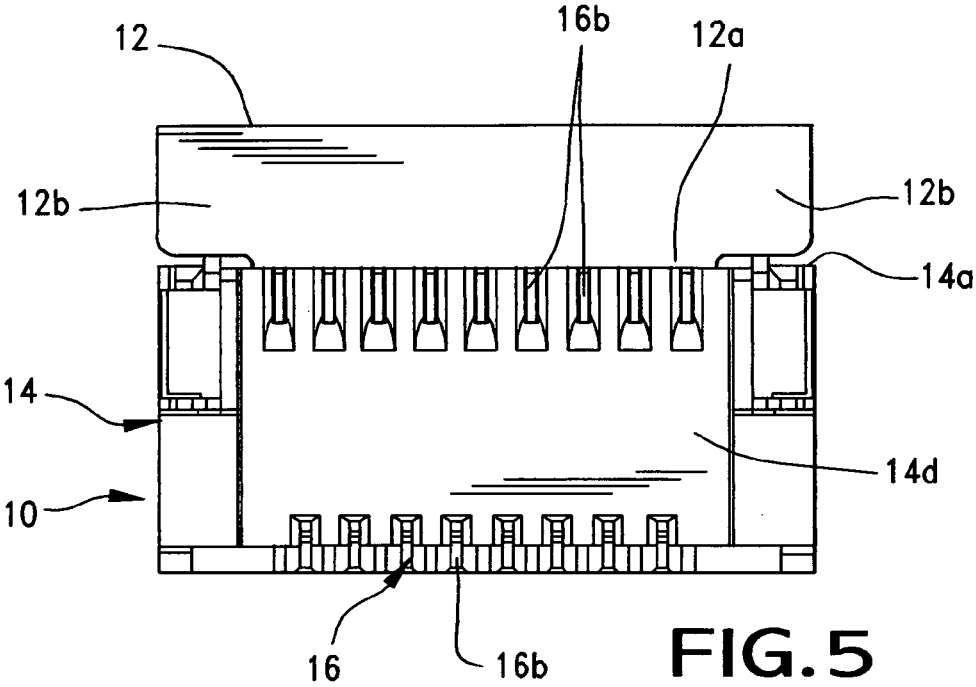
FIG. 5 is a bottom plan view of the connector.

Referring to the drawings in greater detail, and first to FIGS. 1–6, the invention is embodied in a flat circuit electrical connector, generally designated 10, for terminating a flat electrical circuit, generally designated 12. The flat circuit may be a flat flexible cable, a flexible printed circuit board or the like. Connector 10 includes a dielectric housing, generally designated 14, mounting a plurality of terminals, generally designated 16. An actuator, generally designated 18, is pivotally mounted on the housing for movement between an open position (FIG. 7) allowing the flat circuit to be inserted into the connector and a closed position (FIGS. 1–6) to relatively bias the flat circuit against the terminals. The connector is designed or adapted for mounting on a flat substrate, such as a printed circuit board, generally designated 20.

More specifically, housing 14 of connector 10 may be molded of dielectric material such as plastic or the like. The housing has a front end 14*a*, a rear end 14*b*, a top wall 14*c* and a bottom wall 14*d*. The housing is open at the front and top thereof to define an opening 22 for receiving flat circuit 12, and a cavity 24 within which actuator 18 is movable between its open and closed positions.

Terminals 16 of connector 10 are mounted in housing 14 in a generally parallel, spaced array along opening 22 and cavity 24 of the housing. Each terminal includes a contact arm 16*a* (FIG. 7) cantilevered into cavity 24 for engaging an appropriate contact pad on the bottom of flat circuit 12. Each terminal 16 also includes a tail portion 16*b* (FIG. 5) for connection, as by soldering, to an appropriate circuit trace on printed circuit board 20.

Figure 7:
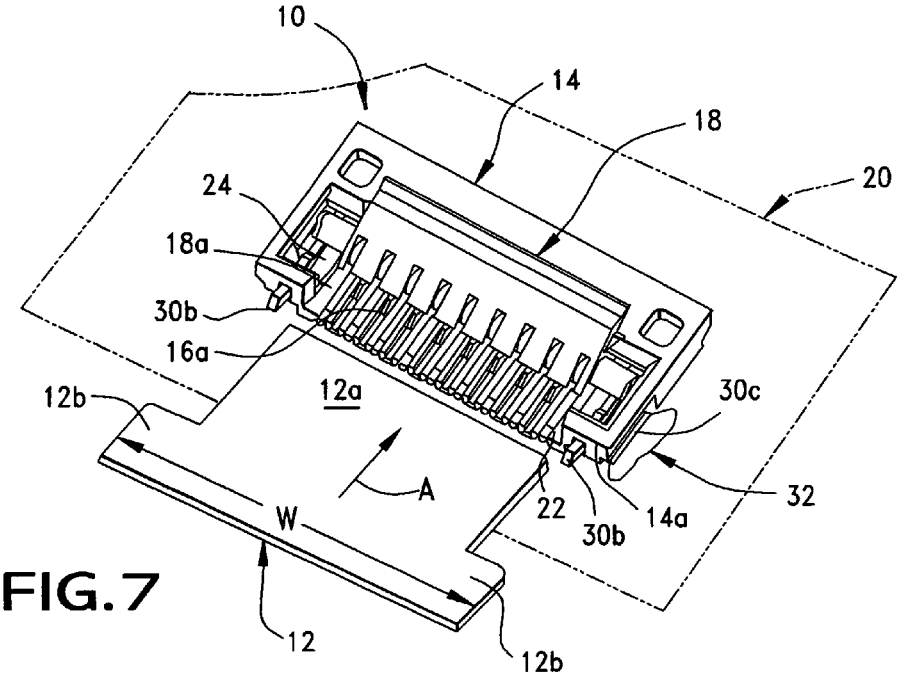
FIG. 7 is a view similar to that of FIG. 1, with the actuator in its open position and the flat circuit about to be inserted into the connector.

Before proceeding to a description of the circuit-suppressing means of the invention, reference is made to FIG. 7 wherein flat circuit 12 is shown in detail. The flat circuit has a given width "W" and an insertion end 12*a* which is narrower than the given width to define a pair of shoulder sections 12*b* which project transversely beyond insertion end 12*a*. The flat circuit is inserted into opening 22 in the direction of arrow "A".

Figure 6:
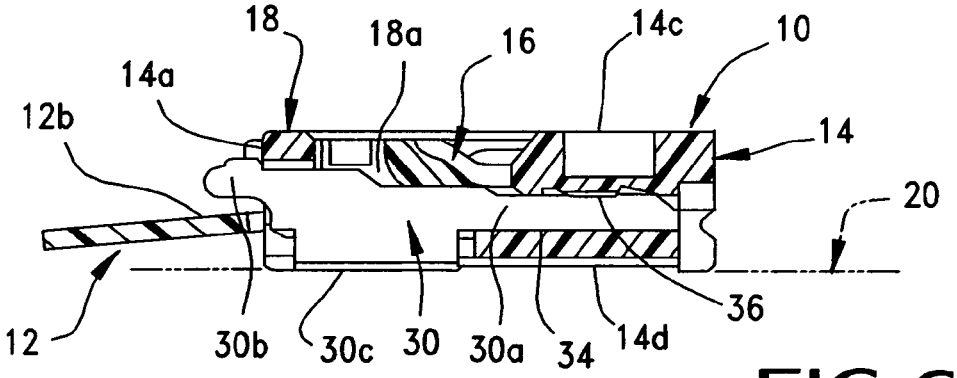
FIG. 6 is an enlarged section taken generally along line A—A in FIG. 4.

As best seen in FIG. 6, a pair of circuit-suppressing members, generally designated 30, are mounted in housing 14 outside opposite ends of opening 22. Each circuit suppressing member is separate from the housing and can be stamped of metal material. Each circuit-suppressing member includes a rearwardly projecting mounting portion 30*a*, a forwardly projecting head portion 30*b* and a generally perpendicular fixing portion 30*c* for connection, as by soldering 32 (FIGS. 1 and 7) to an appropriate mounting pad on printed circuit board 20. The circuit-suppressing member is mounted in the housing by inserting mounting portion 30*a* into a hole 34 in the housing wherein the mounting portion establishes a press-fit, as at 36, to fix the circuit-suppressing member to the housing. When fully mounted, head portion 30*b* of the circuit-suppressing member projects outwardly from the front end or face 14*a* of the housing as is seen clearly in FIG. 6. As seen clearly in FIGS. 1, 2 and 7, head portions 30*b* of the circuit-suppressing members are disposed outside opposite ends of opening 22.

Figure 8:
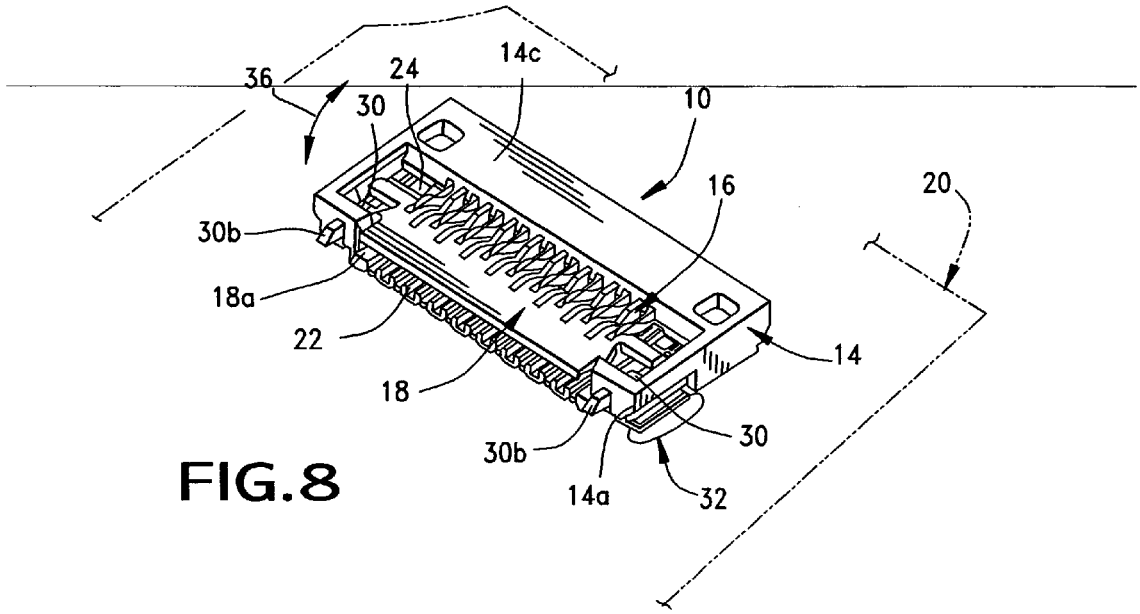
FIG. 8 is a view similar to that of FIG. 1, with the flat circuit removed.

As stated above, actuator 18 is pivotally mounted on housing 14 for movement between an open position (FIG. 7) which allows insertion of insertion end 12*a* of flat circuit 12 into opening 22, and a closed position (FIGS. 1–6 and 8) whereat the flat circuit is biased downwardly against cantilevered contact arms 16*a* of terminals 16. This movement is shown by double-headed arrow 36 in FIG. 8.

With actuator 18 in its open position as shown in FIG. 7, insertion end 12*a* of flat circuit 12 can be easily inserted in the direction of arrow "A" into opening 22 without any interference whatsoever by head portions 30*b* of the circuit-suppressing members 30. That is because the head portions are located laterally outwardly of the opening and project forwardly from front end 14*a* of the housing generally parallel to and opposite the insertion direction "A".

When flat circuit 12 is fully inserted into opening 22 of housing 14 of connector 10, shoulder sections 12*b* of the flat circuit move under head portions 30*b* of the circuit-suppressing members as is shown clearly in FIGS. 1–6. Moving the shoulder sections under the head portions of the circuit-suppressing members is easily accomplished because insertion end 12*a* of the flat circuit now has been inserted under actuator 18 in the open position of the actuator.

Figure 9:
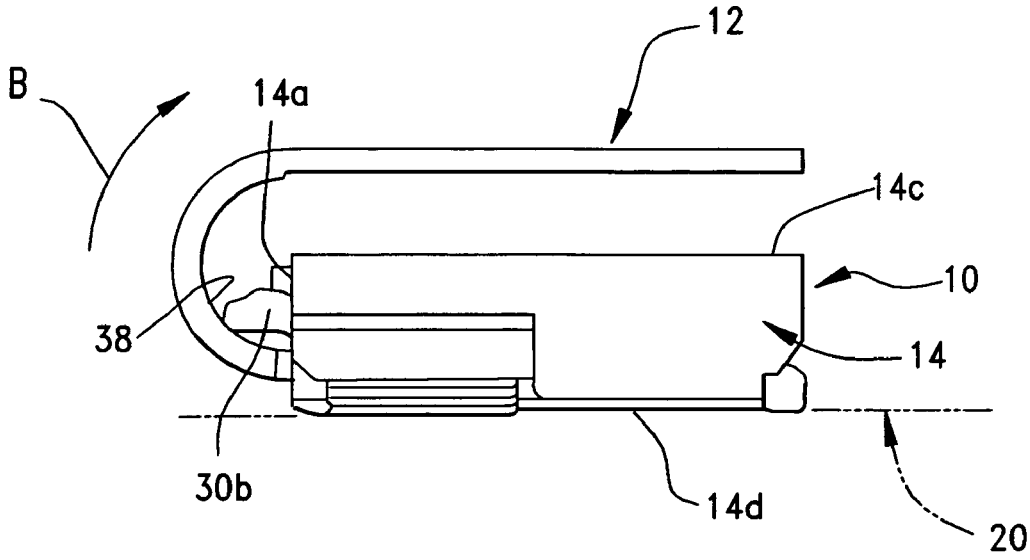
FIG. 9 is a side elevational view of the connector, with the flat circuit bent upwardly against the circuit-suppressing members.

FIG. 9 shows a condition wherein flat circuit 12 has been bent outwardly and upwardly in the direction of arrow "B". It can be seen that head portions 30*b* of the circuit-suppressing members abut against a top surface 38 of the flat circuit. This prevents the upwardly-pulled flat circuit from engaging a front edge 18*a* (FIG. 1) of actuator 18. If the flat circuit engages the front edge of the actuator (i.e., without circuit-suppressing members 30), the flat circuit would lift or pivot the actuator away from its closed position and loosen the connections between contact arms 16*a* and the contacts of the flat circuit, thereby adversely affecting or even opening these connections. However, with the circuit engaging head portions 30*b* of circuit-suppressing members 30, the actuator continues to lock the circuit in the connector.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical connector for terminating a flat electrical circuit which has a given width and an insertion end narrower than said given width to define a pair of shoulder sections at opposite sides of the circuit, comprising:

a dielectric housing having an opening for receiving the insertion end of the flat circuit in an insertion direction;

a plurality of terminals mounted on the housing at said opening;

an actuator movably mounted on the housing for movement between an open position allowing the insertion end of the flat circuit to be inserted into said opening and a closed position to relatively bias the flat circuit against the terminals; and a pair of circuit-suppressing members separate from the housing and projecting forwardly from a front face of the housing outside said opening located beyond edges of the narrower insertion end in a direction generally parallel to and opposite said insertion direction for engaging the shoulder sections of the flat circuit to prevent the flat circuit from being bent upwardly against the actuator.

2. The electrical connector of claim 1 wherein said circuit-suppressing members are mounted in slots in the housing.

3. In combination with the electrical connector of claim 1 a flat electrical circuit having said narrow insertion end and said shoulder sections at opposite sides of the circuit.

4. The electrical connector of claim 2 wherein said circuit-suppressing members include mounting portions inserted into said slots and head portions for engaging the shoulder sections of the flat circuit.

5. The electrical connector of claim 4 wherein said circuit-suppressing members are stamped of metal material.

* * * * *